US008704623B2

(12) United States Patent
Dumonski

(10) Patent No.: US 8,704,623 B2
(45) Date of Patent: Apr. 22, 2014

(54) RECONFIGURABLE HARNESS BOARD

(75) Inventor: Jonathan D Dumonski, Meriden, CT (US)

(73) Assignee: Sikorsky Aircraft Corporation, Stratford, CT (US)

( * ) Notice: Subject to any disclaimer, the term of this patent is extended or adjusted under 35 U.S.C. 154(b) by 1975 days.

(21) Appl. No.: 11/707,716

(22) Filed: Feb. 16, 2007

(65) Prior Publication Data

US 2008/0200040 A1 Aug. 21, 2008

(51) Int. Cl.
*H01F 7/20* (2006.01)

(52) U.S. Cl.
USPC ..... 335/285; 335/286; 335/287

(58) Field of Classification Search
USPC ..... 335/285, 286, 287, 288, 291, 293, 294, 335/302–303; 248/206; 269/8; 439/12, 439/39–40
See application file for complete search history.

(56) References Cited

U.S. PATENT DOCUMENTS

| | | | | |
|---|---|---|---|---|
| 2,673,404 | A * | 3/1954 | Abrahamson | 434/330 |
| 3,942,147 | A * | 3/1976 | Josephson | 335/285 |
| 4,287,676 | A * | 9/1981 | Weinhaus | 40/661.01 |
| 4,830,322 | A * | 5/1989 | Gary | 248/206.5 |
| 5,639,138 | A * | 6/1997 | Smith | 294/142 |
| 5,825,271 | A * | 10/1998 | Hu | 335/285 |
| 6,626,303 | B1 * | 9/2003 | Moodie | 211/70.7 |
| 6,739,567 | B1 * | 5/2004 | Curtis | 248/548 |
| 7,038,567 | B2 * | 5/2006 | Vicentelli | 335/306 |
| 7,114,592 | B1 * | 10/2006 | Gibson et al. | 182/129 |
| 7,325,803 | B1 * | 2/2008 | Miranda | 273/108.5 |
| 7,563,202 | B1 * | 7/2009 | Sudeith | 482/37 |
| 2009/0001641 | A1 * | 1/2009 | Wu et al. | 269/8 |

FOREIGN PATENT DOCUMENTS

| | | | |
|---|---|---|---|
| DE | 10321622 | * | 12/2004 |
| EP | 917414 A1 | * | 5/1999 |

* cited by examiner

*Primary Examiner* — Mohamad Musleh

(74) *Attorney, Agent, or Firm* — Carlson, Gaskey & Olds P.C.

(57) ABSTRACT

An apparatus including a harness board and a clamp removably connected to the harness board with a magnetic field. The magnetic field permits the clamp to be removed from the harness board. Also, a post is removably connected to the harness board using a magnetic field, and the magnetic field permits the post to be removed from the harness board.

20 Claims, 3 Drawing Sheets

RECONFIGURABLE HARNESS BOARD

BACKGROUND OF THE INVENTION

1. Field of the Invention

The present disclosure relates to a board for an aircraft wiring harness. More particularly, the present disclosure relates to wiring harness board that can be reconfigured.

2. Description of the Related Art

For decades the only method for constructing aircraft wiring harnesses involved a laborious manufacturing process where fabricators built the harness based on drawings that were attached to a plywood harness board. Conventionally, the drawings, also called a harness plot, is placed over a sheet of plywood and attachments are mechanically fastened in appropriate locations on the plywood board.

An operator mechanically fastens each attachment to the plywood board using a fastening device such as a screw. These attachments are then used to form and secure a wiring harness as it is being built. When the board is built, it is carried from the board building area and delivered to the manufacturing area.

After the harness board has been delivered to the point of use (i.e. harness manufacturing area), it can be used to construct a harness. After assembly of the harness on the harness board, the harness is removed from the harness board. Then, the board is removed from the manufacturing area, and the attachments can be removed from the harness board, or the board can be placed into storage for later use. Harness boards are saved for future use in light of their cost.

The storage of the conventional harness boards requires a substantial amount of space. The time required to setup a new board is substantial considering each attachment must be mechanically attached to the harness board. The life span of harness boards that use mechanically attached attachments is short due to the wear and tear caused by repeated removal and reattachment of the mechanically attached parts.

The transport of conventional harness boards from a storage area to the point of use involves risk of injury from the constant rebuilding and transporting throughout the manufacturing area. Also, a substantial amount of time is expended transporting the harness boards from the storage area to the point of use, including the time spent tearing down a board for reuse.

Therefore, there exists a need for harness boards or methods of preparing a harness board that overcomes, mitigates, and/or alleviates one or more or other deleterious effects and deficiencies of the prior art.

SUMMARY OF THE INVENTION

The present disclosure provides an apparatus including a harness board and a clamp removably connected to the harness board with a magnetic field. The magnetic field permits the clamp to be removed from the harness board. Also, a post is removably connected to the harness board using a magnetic field, and the magnetic field permits the post to be removed from the harness board.

The present disclosure also provides an apparatus that includes a harness board having a metallic surface that is attracted to a magnetic field. A clamp is magnetically fastenable to the harness board. The clamp has a first magnetic base having a cup-shaped receptacle in which a first magnetic element is secured, and the clamp is capable of supporting a wiring harness. A post is magnetically fastenable to the harness board. The post has a second magnetic base having a cup-shaped receptacle in which a second magnetic element is secured, and the post is capable of supporting a wiring harness.

BRIEF DESCRIPTION OF THE DRAWINGS

These and other advantages and benefits of the present disclosure will be more apparent from the following detailed description of the present disclosure, in conjunction with the accompanying drawings wherein.

DETAILED DESCRIPTION OF THE PREFERRED EMBODIMENTS

Figure 1:
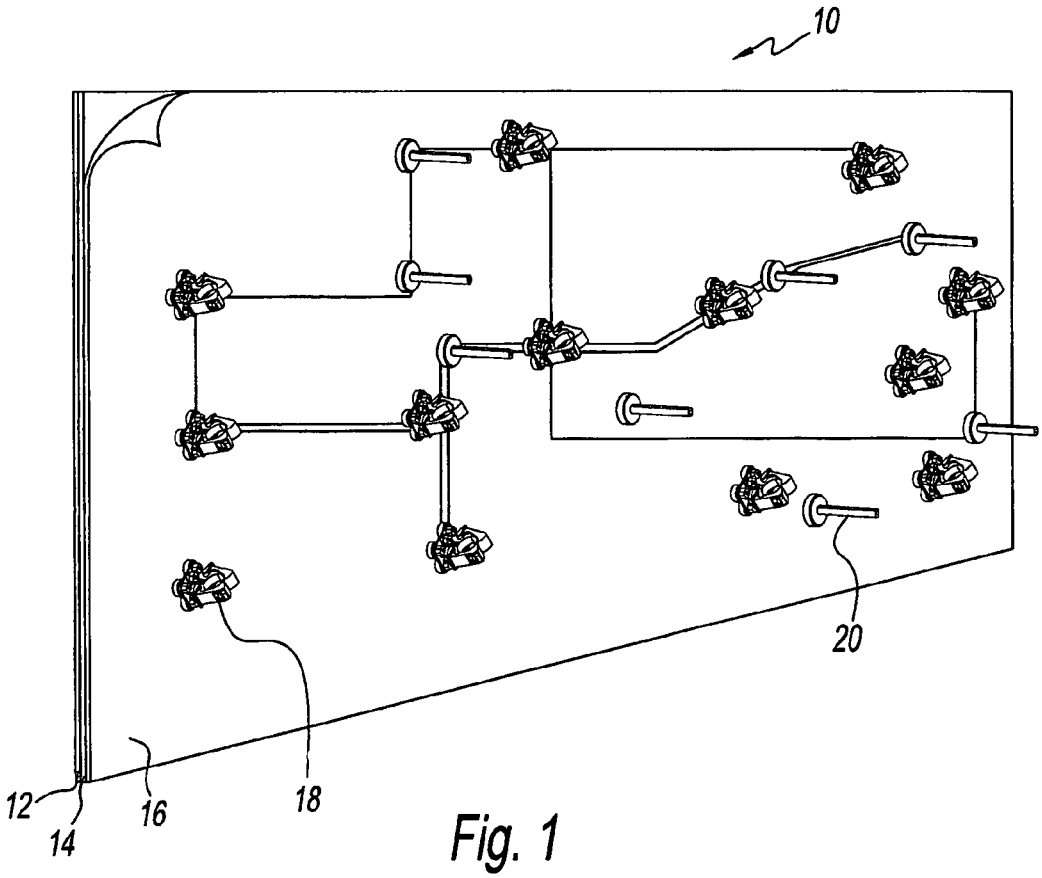
FIG. 1 is a perspective view of an exemplary embodiment of the harness board according to the present disclosure.

FIG. 1 is an exemplary embodiment of harness board 10 according to the present disclosure. Harness board 10 is shown having two layers, layer 12 and layer 14. Layer 12 can be constructed of plywood or a similar material, including, but not limited to particleboard or plastic sheeting. Layer 14 can be constructed from steel or another material demonstrating susceptibility to an external magnetic field. This substance chosen can be steel, or another substance containing iron, or another ferromagnetic material. In some embodiments, layer 14 can be constructed from other materials that are not susceptible to an external magnetic field, such as a plastic sheet.

Layers 12 and 14 can be connected along the planar surfaces of each layer using an adhesive, or fastening device known in the art. Alternatively, harness board 10 can be formed using a single layer (not shown), wherein layer 14 constructed of a material susceptible to magnetic fields is used to supply the single layer.

Harness board 10 uses a harness plot 16 that is placed on top of, and secured to layer 14 with a clamp, or another similar instrument. Harness plot 16 is generally a diagram or blueprint that plots the wiring harness layout. Harness plot 16 can also plot the positions of clamps 18 and posts 20, which are used to hold the wiring harness (not shown) as it is being built.

Clamps 18 and posts 20 can be equipped with magnets that enable clamps 18 and posts 20 to be attached to layer 14 with harness plot 16 placed between. In some embodiments, the magnetic material and magnets used in the presently disclosed apparatus are derived from permanent magnets. Clamps 18 and posts 20 equipped with magnets enables clamps 18 and posts 20 to be repositioned on harness board 10.

Figure 2:
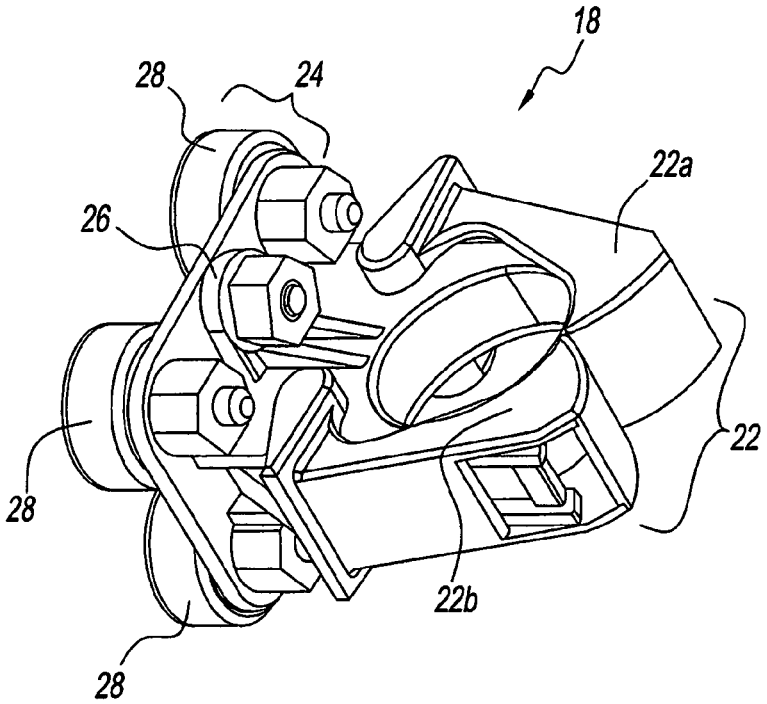
FIG. 2 is a perspective view of a clamp that is attached to the harness board shown in FIG. 1.

FIG. 2 is an enlarged perspective view of clamp 18 that is attached to harness board 10. Clamp 18 is included a clamping unit 22 that is comprised of prongs 22*a* and 22*b*. Prongs 22*a* and 22*b* can be flexible elements that can be separated to enable wire harness elements to be clamped between them. In some embodiments, prongs 22*a* and 22*b* can be attached to clamp 18 with a spring mechanism that enables the prongs to be flexed outward.

Clamping unit 22 is attached to base 24 using brackets 26. Brackets 26 can be placed on either side of clamping unit 22. Attached to base 24 are several disks 28 that house magnets. Although several receptacles are shown, a single receptacle can be used to secure clamp 18 to harness board 10. In some embodiments, disks 28 are cup-shaped receptacles with hollow recessed in which a magnetic element can be secured.

Figure 3:
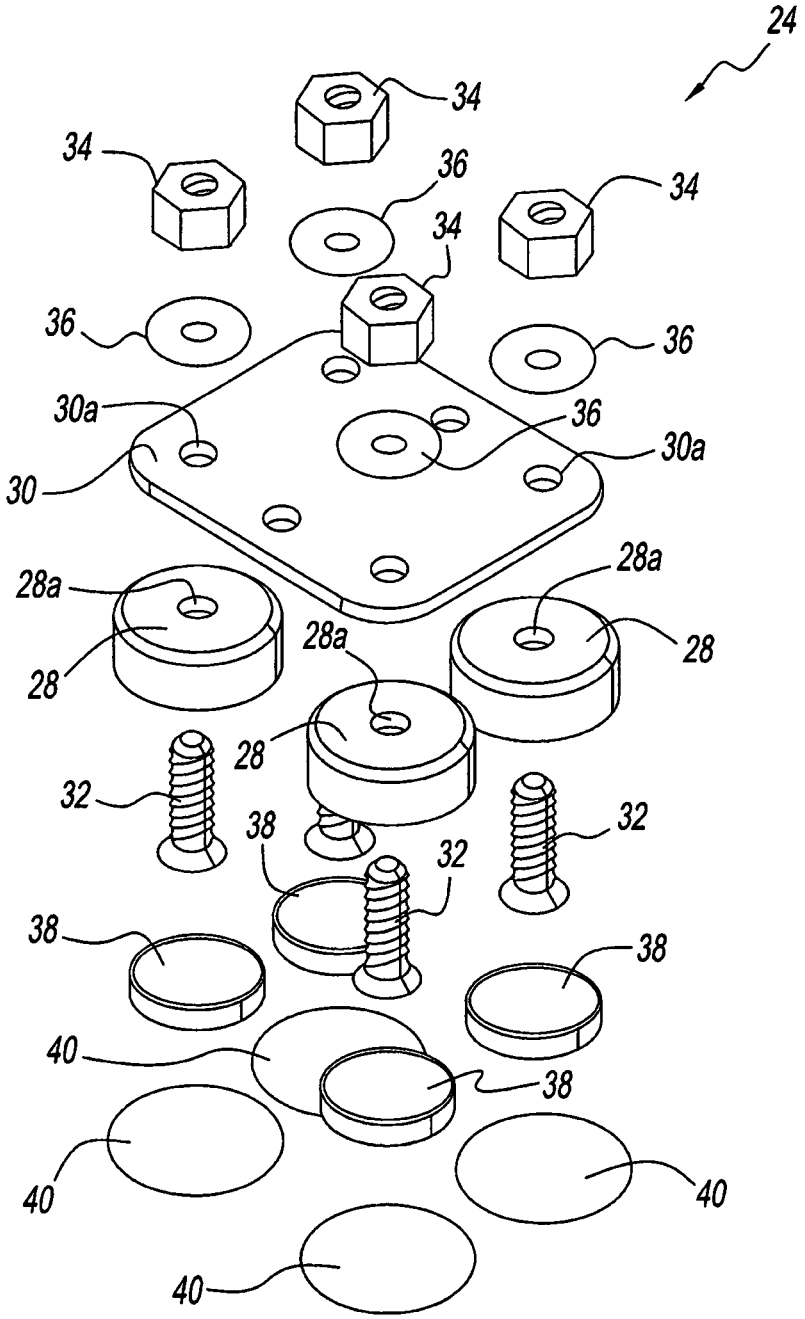
FIG. 3 is an exploded view of the base for the clamp shown in FIG. 2.

FIG. 3 is an exploded view of base 24 for clamp 18 shown in FIG. 2. Base 24 shows that several disks 28 can be secured to plate 30 by inserting screws 32 through apertures 28*a* in disk 28 and apertures 30*a* in plate 30, and then securing threading nuts 34 unto screws 32. Alternatively, a washer 36 can be placed between the nuts 34 and plate 30. Disks 28 are shown as circular structures, but this element could be various shapes and sizes.

The attachment of disks 28 can also be accomplished using a weld, adhesive, rivets or another attachment means known in the art. Thus, screws 32 and nuts 34 can be eliminated as well as apertures 28*a* and 30*a*. In some embodiments, base 24 can be composed of a magnetic material and disks 28 can be eliminated. In such an embodiment, clamp unit 22 would be attached to base 24, which could be various shapes and sizes.

Disks 28 are intended to house magnets 38 within a hollow recess inside the receptacle. Magnets 38 can be secured inside the hollow recess of disks 28 using an adhesive. In some embodiments, disks 28 do not have hollow recesses, but instead are constructed of a permanent magnetic material, thus relieving the need to use separate magnets 38.

In some embodiments, a soft and/or cushioned material 40 can be attached to magnets 38 as circular patches, or in the alternative embodiment of clamp 18, in which magnets 28 are substituted by a magnetic base 24, base 24 can have a soft and/or cushioned material attached. Material 40 is intended to shielded harness plot 16, which is typically a paper plot, from damage that could ordinarily be caused by sharp edges on clamps 18 as they are attached and reattached to harness board 10.

Figure 4:
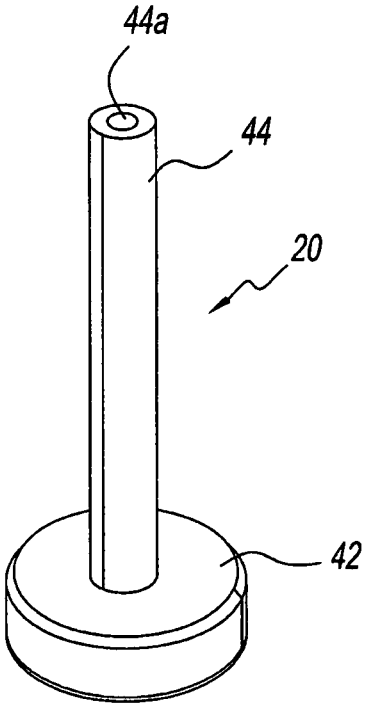
FIG. 4 is a perspective view of a post that is attached to the harness board shown in FIG. 4.
Figure 5:
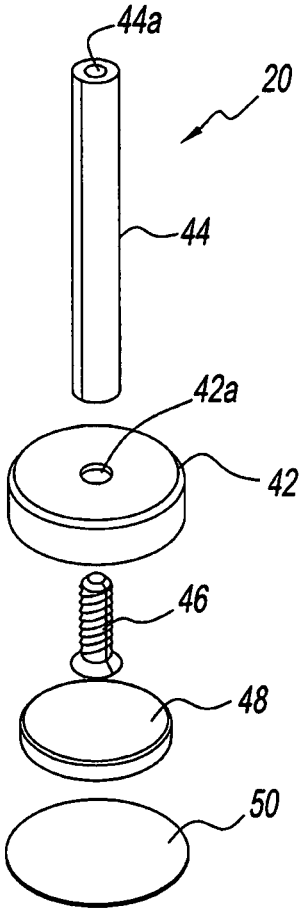
FIG. 5 is an exploded view of the post shown in FIG. 4.

FIG. 4 is a perspective view of post 20, which is attached to the harness board 10. Post 20 has a base 42 attached at one end of shaft 44. Base 42 is shown as a circular structure, but it should be understood that base 24 could be various shapes and sizes. FIG. 5 is an exploded view of post 20. In this view it is shown that base 42 has an aperture 42*a* through which a screw 46 can be inserted through, and threaded into bore 44*a* of shaft 44. Shaft 44 can also be joined to base 42 using a weld, adhesive, a rivet or another fastening means known in the art. In some embodiments, base 42 is a cup-shaped receptacle with a hollow recess in which a magnetic element can be secured.

A magnet 48 can be fastened inside a recess in base 42, and a soft and/or cushioned material is attached to magnet 48 to prevent damage to harness plot 16 as post 20 is attached and moved about harness board 10. In some embodiments, base 42 is a comprised of magnetic material and magnet 48 is eliminated.

Magnetic components on clamp 18 and post 20 enable one to construct harness board 10 needed to construct a wiring harness for an aircraft in a fraction of the time previously needed. Conventional harness boards that used attachments that were mechanically fastened to a plywood harness board, required 3-5 hours to construct. Harness board 10 eliminates the time normally spent fastening the attachments to the harness board, by implementing the magnetic elements and metallic harness board described herein.

Harness board 10 is also reusable innumerable times, while conventional plywood harness boards have a short half-life due to the wear that occurs from repeated fastening and unfastening of mechanically fastened attachments to and from the wooden board. A side benefit of using clamps 18 and posts 20, which are not mechanically fastened, is that the harness plot is not ripped or punctured during the prepping of the harness board for construction of a harness. Since clamps 18 and posts 20 are secured to harness board 10 using magnets, the underlying harness plot is not damaged.

Another benefit of harness board 10 is that clamps 18 and posts 20 can be attached and removed from harness board 10 quickly. Exerting enough force to break the magnetic bond between board 10 and clamp 18 and post 20 free the clamp or post to be used again. This enables harness board 10 to remain at the point of use since new harness plots can be secured to board 10 repeatedly without any alteration of the board. The necessary clamps 18 and posts 20 can be secured to harness board 10 is a matter of moments. Thus, countless harnesses can be constructed with the same harness board 10, by applying a new harness plot 16 and reconfiguring clamps 18 and posts 20.

While the instant disclosure has been described with reference to one or more exemplary embodiments, it will be understood by those skilled in the art that various changes may be made and equivalents may be substituted for elements thereof without departing from the scope thereof. In addition, many modifications may be made to adapt a particular situation or feature to the teachings of the disclosure without departing from the scope thereof. Therefore, it is intended that the disclosure not be limited to the particular embodiment(s) disclosed as the best mode contemplated for carrying out this disclosure, but that the disclosure will include all embodiments falling within the scope of the disclosure.

What is claimed is:

1. An apparatus, comprising:

a harness board to support a harness plot; and at least one wire support removably connected to said harness board with a magnetic field, such that said harness plot is positioned between said harness board and said at least one wire support, wherein said magnetic field permits said wire support to be removable from said harness board; said at least one wire support operable to support a portion of a wiring harness on said harness board.

2. The apparatus of claim 1, wherein said harness plot has indicia upon the surface of said harness plot that illustrates the position to place said at least one wire support and at least one wiring harness component.

3. The apparatus of claim 1, wherein said harness plot further comprises a first layer comprised of wood and a second layer comprised of a material attracted to a magnetic field.

4. The apparatus of claim 3, wherein said second layer is steel.

5. The apparatus of claim 1, wherein said at least one wire support is a clamp operable to receive said portion of said wiring harness.

6. The apparatus of claim 1, wherein said at least one wire support is a post arranged to support the wiring harness components.

7. The apparatus of claim 5, wherein said clamp has a base and a magnetic material attached to said base.

8. The apparatus of claim 6, wherein said post has a base and a magnetic material attached to said base, said base supports a shaft which defines a lesser diameter than said base, said shaft operable to support said portion of said wiring harness.

9. The apparatus of claim 5, wherein said clamp has a first prong and a second prong that are flexible to receive said portion of said wiring harness.

10. The apparatus of claim 1, wherein said at least one wire support can be magnetically fastened to any point on the surface of said harness board.

11. The apparatus of claim 1, wherein said at least one wire support is only magnetically fastenable to said harness board.

12. An apparatus, comprising:

a harness board to support a harness plot;

at least one clamp magnetically fastenable to said harness board such that said harness plot is positioned between said harness board and said at least one clamp, wherein said at least one clamp has a first magnetic base having a cup-shaped receptacle in which a first magnetic element is secured, said at least one clamp operable to support a portion of a wiring harness; and at least one post magnetically fastenable to said harness board, such that said harness plot is positioned between said harness board and said at least one post, wherein said at least one post has a second magnetic base having a cup-shaped receptacle in which a second magnetic element is secured, said at least one post operable to support a portion of said wiring harness.

13. The apparatus of claim 12, wherein said second magnetic element emits a magnetic field sufficient to fasten said post to said harness board, and enable said post to be removed from said harness board.

14. The apparatus of claim 12, wherein said first magnetic element is a permanent magnet.

15. The apparatus of claim 12, wherein said second magnetic element is a permanent magnet.

16. The apparatus of claim 5, wherein said clamp defines a first flexible element and a second flexible element to receive said portion of said wiring harness.

17. The apparatus of claim 12, wherein said post has a base and a magnetic material attached to said base, said base supports a shaft which defines a lesser diameter than said base, said shaft operable to support said portion of said wiring harness.

18. The apparatus of claim 12, wherein said clamp has a base and a magnetic material attached to said base, said base supports a first flexible element and a second flexible element to receive said portion of said wiring harness.

19. The apparatus of claim 18, further comprising a multiple of disks mounted to said base, each of said disks supports a magnetic material.

20. The apparatus of claim 19, wherein said multiple of disks are cup-shaped receptacles.

* * * * *